United States Patent [19]

Andrews

[11] 4,028,814

[45] June 14, 1977

[54] PIVOTING RULE

[76] Inventor: Peter Andrews, 190 Gebhardt Road, Penfield, N.Y. 14526

[22] Filed: June 28, 1971

[21] Appl. No.: 157,774

Related U.S. Application Data

[63] Continuation-in-part of Ser. No. 13,015, Feb. 20, 1970, abandoned, which is a continuation-in-part of Ser. No. 699,199, Jan. 19, 1968, Pat. No. 3,510,950, which is a continuation-in-part of Ser. No. 167,609, Jan. 24, 1962, Pat. No. 3,364,581.

[52] U.S. Cl. ..... 33/94; 33/102

[51] Int. Cl.[2] ..... B43L 7/06

[58] Field of Search ..... 33/94, 95, 103, 102

[56] References Cited

UNITED STATES PATENTS

| | | | |
|---|---|---|---|
| 236,469 | 1/1881 | Walters | 33/94 |
| 282,583 | 8/1883 | Starrett | 33/94 |
| 715,703 | 12/1902 | Starrett | 33/94 |
| 1,213,578 | 1/1917 | Bodmer | 33/102 |
| 1,525,813 | 2/1925 | King | 33/102 |
| 1,984,951 | 12/1934 | Stowell | 33/103 |
| 2,296,531 | 9/1942 | McQueen | 33/27 C |
| 2,448,440 | 8/1948 | King | 33/95 |
| 2,489,830 | 11/1949 | Stone | 33/42 |
| 2,841,879 | 7/1958 | Lanski | 33/189 |
| 3,513,548 | 5/1970 | Itano | 33/27 C |

*Primary Examiner*—Harry N. Haroian

[57] ABSTRACT

A graduated, grooved rule and/or graduated slotted and grooved rule member for use in combination with the subcombination head means of combination tool. For example, the subcombination head means of a combination square, the subcombination head means of a bevel protractor; combination head means of a builder's combination tool, square; subcombination head means of a double square; subcombination head means of a reliable try square; subcombination head means of a die maker's square and the like.

This pivoting rule or blade may be substantially pivoted 180° on a short nib or rib, transverse nib or rib, or a substantially spherical faced nib member, one of which is substantially in the head means of the above combination tools for either; presenting a notched-out rule corner portion, or a different rectilinear edge or a different set of graduations and corresponding indicia to at least one side edge of the subcombination head means by substantially pivoting the rule 180° substantially in said head and generally against and around a portion of the nib; or slide and disconnect the head means from this "Pivoting Rule" invention. The above operations are accomplished by having a reversing, pivoting or a turn-around opening, cavity or area in at least one end portion of the groove and/or the slot of a slotted and grooved rule member, and/or in a narrow or wide grooved portion of the rule member.

15 Claims, 15 Drawing Figures

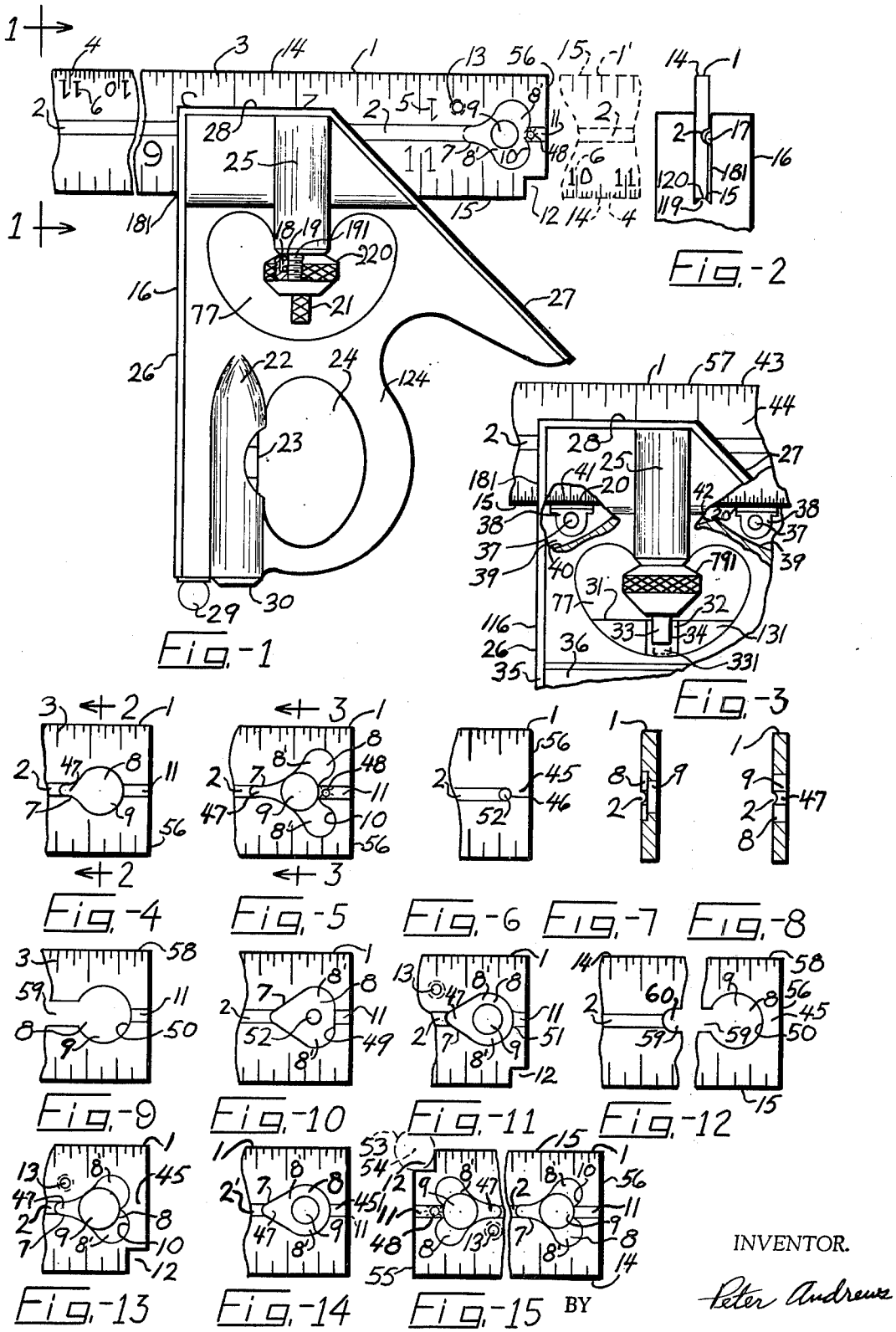
INVENTOR.
BY Peter Andrews

PIVOTING RULE

This application is a continuation-in-part of my copending application, Ser. No. 13,015, filed Feb. 20, 1970, now abandoned, which was a continuation-in-part of my copending application Ser. No. 699,199, filed Jan. 19, 1968, now U.S. Pat. No. 3,510,950, which was a continuation-in-part of my copending application Ser. No. 167,609, filed Jan. 24, 1962, now U.S. Pat. No. 3,364,581 issued Jan. 23, 1968.

SUMMARY OF INVENTION

The present invention relates substantially to improvements in at least the conventional rule member that was invented by L. S. Starrett in 1883 and which is presently being used in combination with the disclosed subcombination head means having separate adjunct members of, for example, conventional combination squares, bevel protractors and center heads. This pivoting rule member or invention is further used, for example, in place of the captive pivoting rule members of L. S. Starrett in 1902; of the pivoting rule invented by L. S. Starrett in 1922; of Bodmer in 1915; of Stowell in 1931 and the free sliding conventional graduated and grooved rule member as in a Starrett No. 9 combination set, or in the Starrett No. H-11, H-33, C-11, C-33 PR-1224 and PNR-1224 subcombination head means. This pivoting rule invention is also to be used with the subcombination head means of, for example, the Starrett No. 439, 61, 13, 14, 453 and subcombination protractor head means Starrett No. 359.

It is well known that it is, at times, very annoying and/or difficult for a person to reinsert the transverse rib or nib, of a graduated, grooved rule clamping stud means, back into the longitudinal groove extending in the face of the conventional rule member, when the rule member is slipped entirely free from the head of the square, protractor or center head.

For example, the grooved rule releasably clamping longitudinally long transverse rib 9 of J. W. Parker U.S. Pat. No. 1,519,209 in 1925 and the U.S. Pat. No. 2,448,440 was issued on Aug. 13, 1948 to E. I. King, and was an invention to overcome the above disclosed rib or nib engaging inconvenience, and to facilitate the reinsertion of the longitudinally long transverse rib or nib 6 into the groove 4 of the rule member 2, of King.

It is also well known that combination squares used by carpenters, mechanics, tool makers, artisans, handy men and the like have been patented for allowing a person to substantially pivot a partially grooved rule member or a partially slotted rule member substantially in the subcombination head means of a square, by having a conventional longitudinally long transverse rib or nib engaged substantially in a rib or nib enlarged turnaround opening or area in at least one end of the conventionally narrow groove 2 or in a wide (not shown) elongated slot 2.

It is further well known that various combination devices have been patented to also prick punch a surface, through use of special attachments to a conventional grooved or slotted rule member which is substantially in combination with the subcombination head means of a square.

It is accordingly also still further well known that a partially grooved rule member was also patented for substantially pivoting the captive rule member 180° substantially in the subcombination head means of the square, for example, as is disclosed and shown in the patented pivoting rule invention of E. P. King, U.S. Pat. No. 1,525,813, issued Feb. 10, 1925, being assigned to the L. S. Starrett Co. The U.S. Pat. No. 1,525,813 captive pivoting rule invention was preceded by the pioneer grooved rule invention being the L. S. Starrett combination square or beveling instrument U.S. Pat. No. 282,583 issued on Aug. 7, 1883 and having a transverse rib or nib portion of a grooved rule 57 releasably clamping stud member that is releasably clamped in a longitudinal groove in one face of a graduated rule member but being slidingly freed out of both ends of the groove. Still another patent was further also issued to L. S. Starrett, U.S. Pat. No. 715,703 being issued on Dec. 9, 1902 having a captive partially slotted E rule member F. The Stanley Works owned the captive rule members of the Bodmer and Stowell having U.S. Pat. No. 1,213,578 in 1917 and U.S. Pat. No. 1,984,951 of Stowell in Dec. 18, 1934.

The rib or nib of the U.S. Pat. Nos. 1,525,813; 715,703; 1,984,951 and 1,213,578 are substantially impossible to be entirely removed from the groove or slot of the captive rule member in the heads of the square without entirely unscrewing the nut of the rule member's releasably clamping nib ended stud and nut means. It is also noted that the disclosure in U.S. Pat. No. 1,525,813 substantially states that, "the stock or head will be positively prevented from being disconnected from the blade and will yet be capable of reversal upon the blade," being substantially the direct opposite of this non-captive Pivoting Rule invention wherein the subcombination tool head means may either be pivoted 180° or be slid on and off of the improved rule member, as desired, in substantially one operation.

A primary object of my pivoting rule invention is to enable a person to either; substantially pivot the improved rule means 180° substantially in the rule receiving slot in one portion of the square or protractor subcombination head means for presenting a different set of graduations and corresponding indicia to at least one side edge of the head, or enable a person to slide and entirely disconnect or remove the rule means from the head as desired, without substantially disassembling any portion of the conventional rule releasably clamping stud and nut means.

Another important object of my pivoting rule invention is to still enable a person to readily use and slide the subcombination head means of a combination tool, for example, being from a combination; square, bevel protractor or a center head having a longitudinal groove in one face thereof; also on and off of the improved pivoting rule means, as one desires, and without loosening the threaded nut of the rule releasably clamping means more than, for example, ⅛ to ¼ of a resolution for a grooved rule only and generally 1 to say 4 resolutions for a slotted and grooved rule.

Another object of my pivoting rule invention is to enable a person to use a combination tool with improved great facility.

And another object of my invention is to convert a conventional and a non-conventional wide longitudinally grooved rule member into a "dead ended grooved" pivoting rule means by rigidly inserting, pressing, screwing, cementing, soldering, adhesively securing, welding, coining an integral stop, boss or obstruction and the like, for creating a nib stop or blocking means in one generally extreme end portion of the conventional and non-conventional groove means that is in and across the entire longitudinal length of the face thereof. The nib stop or blocking dead ended portion may also be an integral face portion of the rule member, if so desired.

A still further object of my pivoting rule invention is to use it in combination with a short nib, longitudinally long transverse rib or nib and/or with a substantially spherical faced nib means, as desired, to substantially pivot my pivoting rule invention for presenting a notched-out corner thereof, that receives an end portion of a Starrett Automatic Center Punch No. 819, for example, in spaced relation from at least one side edge of the square's head, when it is desired to prick or center punch a surface, and without adding or subtracting any measurement or indicia for the radius of the nesting diameter of the center punch. An opening may also be provided in a cavity wall portion or the nib turn around opening itself receive the above center punch nesting diameter but a dimension must be added to the extended length of the rule member.

Another further object of my pivoting rule invention is to have English and/or Metric set of graduations and corresponding set of indicia on the same face of at least one face side of the rule member or means, whereby the rule member or means may be substantially pivoted 180 degrees in the head means of the square for presenting either one of the above set of different graduations and corresponding indicia to at least one side edge of the head means of the square and/or protractor and having the desired indicia substantially readable right side up as more fully disclosed in my copending application Ser. No. 699,199. Graduations and corresponding indicia may also be inserted into the bottom wall portion of a wide longitudinally grooved pivoting rule member or means, as desired, whereby 3 sets of different graduations and indicia would be readable from one face side of the rule member or means.

Other objects, new uses, and/or advantages will become apparent substantially to persons skilled in the combination tool or square art, upon reading the following disclosure and claims accordingly.

For a better and full understanding of the nature and objects of my "Pivoting Rule" invention reference should be respectfully made to my copending application Ser. No. 699,199 and copending application Ser. No. 14,026 filed Feb. 25, 1970 and reference should respectfully be further made to the following brief description and the detailed description and operation thereof taken further in conjunction with the accompanying drawing wherein:

FIG. 1 is a partial side elevational view of the pivoting rule member 1 being releasably clamped in a conventional subcombination head means of a combination tool or square.

FIG. 2 is an end elevational view taken substantially along line 1–1 of the combination shown in FIG. 1, in the direction indicated by the arrows.

FIG. 3 is a partial side elevational view of this pivoting rule invention or a conventional rule grooved member in combination with an improved subcombination head means of a Sine Pin-Headed Dual Square having the Ser. No. 14,026 filed Feb. 25, 1970 and shown are two partly cut away portions in the head means wherein a pivoting pillow block 38 support member is on each of the two pins 37 while the straight and narrow rectilinear 20 upper portion of the pillow block member supports a rectilinear longitudinal edge of the rule 1 or 57. The pillow blocks 38 and round pins 37 may be replaced with a square keyway type of rule member support means and having the pillow block's narrow or rectilinear rule member support portion 20, as desired.

FIG. 4 is a partial side elevational view of at least one end of the pivoting rule, showing a different shaped, transverse rib or nib, pivoting or reversing opening.

FIG. 5 is another partial side elevational view of at least one end of the rule, showing at least still another different shaped transverse nib reversing cavity.

FIG. 6 is another partial side elevational view of one end of still another version, being a dead ended pivoting rule invention.

FIG. 7 is taken along sectional line 3—3 of FIG. 5 to show the cavity and opening in the wall of the cavity.

FIG. 8 is taken along sectional line 2—2 of FIG. 4 to show the opening and thickness of the rule.

FIG. 9 is a partial side elevational view of at least one end of the rule having at least a slotted and grooved version of this pivoting rule invention.

FIG. 10 is another partial side elevational view of at least one end of this rule pivoting invention showing a different shaped transverse nib reversing cavity having a small opening through the bottom wall of the cavity.

FIG. 11 is still another partial side elevational view of one end of this pivoting rule invention wherein a corner of the rule is notched out and a transverse nib means pivoting or reversing cavity of still a different shape is shown.

FIG. 12 is a partial side elevational view of substantially one end and at least one center length portion of this pivoting rule invention showing a slotted and grooved version of this invention along with a transverse nib enlarged pivoting or reversing conventional opening in one end of the slot while a groove exits entirely out of the other end of the rule generally as shown in FIG. 9.

FIG. 13 is still a further partial side elevational view of one end of this pivoting rule invention showing a different shaped transverse nib pivoting rule invention showing a different combination with a notched out corner for receiving an automatic center punch therein, or in the hole through the bottom wall of the cavity.

FIG. 14 is also another partial side elevational view of at least one end of this pivoting rule invention showing substantially the same view as that shown in FIG. 11.

FIG. 15 is a partial side elevational view of substantially all the FIGS. 1, 4, 5, 10, 11, 13 and 14, for example, whereby one or both ends of the pivoting rule invention, as desired, are to have either one or two transverse nib pivoting or reversing openings and/or cavities, in accordance with this pivoting rule invention.

DETAILED DESCRIPTION

Referring now to the drawing in detail wherein like reference characters or numbers designate like elements throughout the 15 views in the drawing.

FIG. 1 shows this pivoting rule 1 invention releasably clamped in the slotted end 181, shown in FIG. 2, of a conventional subcombination head means 16 having a side edge 26, rear 45° side edge 27, end side edge 28, barrel portion 25 for receiving a threaded transverse nib 17 (not shown) ended stud means 191.

The view further shows a longitudinal extending groove 2 in graduated rule 1, and shown English graduations 3, Metric graduations 4, English indicia 5, Metric indicia 6, curved portion 7 of the transverse nib enlarged opening 8 for aiding the entry and reentry of the transverse nib into the groove 2, when a 180 degree operation of the rule 1 is executed substantially in the head 1 or slot 181, as shown by the dashed outline of rule 1 off the right end of rule 1. The opening 9 is through a bottom wall portion of the enlarged opening 8, and is for nestingly receiving a center punch and bushing set and/or automatic center punch therein and/or is nested in the notch 12, for executing a center punching operation as is more fully disclosed in my copending application Ser. No. 699,199 filed Jan. 19, 1968 wherein the shown tapped hole 13 is also fully disclosed as being used for receiving a threaded screw, for removably securing an arm of a center punch and bushing means, when it is desired to more efficiently execute a center punch operation with a rigidly secured unit, as shown and disclosed in FIGS. 10, 11, 12, 14, 15 and 16, for example, in the Ser. No. 699,199 drawing and disclosure thereof.

The FIG. 1 further shows a rearwardly curved surface 10 in two rear portions of the enlarged opening 8, that prevent a sudden shock or damaging blow to the transverse nib 17 (seen in FIG. 2) when the nib is slid out of the groove 2, generally over a portion of the curved surface 7 and striking with a glancing force against the curved surface 10. It has been found that the curved surface 10 substantially prevents excessive damage to the nib 17 and/or to the enlarged opening 8. Reentry of the nib 17 into the groove 2 is also thereby facilitated by having a substantially undamaged or end peened up, nib 17 end. Accordingly, a round or bullet shaped end (not shown) will also facilitate the reentry of the improved transverse nib 17 which is generally shown in solid lines as being square ended in FIG. 27 of copending application Ser. No. 699,199. The nib referred to above would here be of a non-pivoting type.

The FIG. 1 also shows a short groove 11 which is a continuation of groove 2. The short groove is, accordingly, an important feature portion of this invention, in that without it, the nib 17 could not be physically or bodily detached from that end of the rule 1 or from any end of rule 1, if both ends were thereby closed ended, as is shown and disclosed in the King U.S. Pat. No. 1,525,813 issued Feb. 10, 1925. The bottom wall 8' (prime) of enlarged opening 8 is also shown.

FIG. 1 still further shows the top rectilinear edge 14 of rule 1 and the other rectilinear edge 15 of rule 1, a conventional spirally coiled compression spring 19 housed in cavity 18 which automatically forces the (not shown) nib 17 down against a portion of surface 7 and substantially against the inside curved wall 10 of the necked down portion 47 of enlarged opening 8. The opening 9 may also facilitate hanging of the rule 1 for display arrangement and the like in a store, if so desired. The opening 9 may be eliminated, if desired, whereby the other face side of the rule 1's appearance will not be disfigured but will be conventional or uninterrupted.

FIGS. 1, 5, and 15 show a raised integral boss 48 which is mechanically coined from the other side of the rule 1 (not shown) so that the nib 17 (seen in FIG. 2) will not exit out of the short groove 11 but will exit out of the other end of groove 2 or short groove 11, if so desired. The one sided nib exiting is also possible, if so desired, by the construction instruction of groove 2 in FIGS. 6, 12 and 13. The raised integral surface or boss 48 is in only one short groove 11, as seen in FIG. 15 and was found necessary because a conventional rule 58 (see FIG. 3) means was used and insertion of two enlarged openings 8 resulted in two short grooves 11, as shown in FIG. 15, but the raised boss 48 may be eliminated, if desired.

The upper portion (as seen in FIG. 7) of enlarged opening 8 as is generally shown in FIGS. 1, 4, 5, 9, 10, 11, 12, 13, 14 and 15 is used as a clearance for the top (towards the bottom of the groove 2) surface of nib 17 (see FIG. 2) whereby opening 9 through the wall 8' is substantially the enlarged opening 8 through the entire thickness portion of rule 1, as is shown in FIGS. 4, 9 and 12. Accordingly, from opening 8, the opening 9 breaks through the other face portion of rule 1, if so desired.

FIG. 1 further shows end 21 of a, for example; short nib 17, transverse nib 17, or a spherical nib 17 ended stud means 191. The above 3 nib 17 construction are shown and disclosed in FIGS. 25, 26 and 27 of copending application Ser. No. 699,199.

FIG. 1 also shows conventional level vial housing 22, one outer end 56 edge portion of rule 1, level vial means 23, opening 24, nut 220, opening 77, scriber 29, cover 30 for level vial 23 hole in head 16, dashed line outline of the 180 degree pivoted position of rule 1', edge 14, edge 15 and inverted right side up of Metric indicia 6 and graduations 4.

FIG. 2 shows a top front view portion of head 16 showing rule 1 releasably clamped in slot 181, having edge 15 against the top surface 120 of boss 119 in the bottom of slot 181. Nib 17 is also shown engaged in groove 2 or rule 1, in a conventional way.

FIG. 3 shows this pivoting rule member 1 invention releasably clamped against a top portion of two pivoting pillow block-like rule 1 support members 38 which have supporting pins 37 through a matching hole of said members 38.

A conventional rule means 57 and/or the pivoting rule member 1 having a rectilinear edge 41 against the top narrow rectilinear surface 20 of the member 38 being narrow rectilinear surface 20 will clear away burrs on the outer rectilinear corner portions of the rule member 1 and provide a bearing surface for the center rectilinear portion of the rule member 1. The members 38 having the surface 20 which provides a long wearing surface against the rectilinear sliding and clamping edge 41 of rule member 57 or edge 15 of rule member 1, as desired. A sine angle will also be possible through the use of the two pivoting members 38, substantially as shown and disclosed in FIG. 5 of copending application Ser. No. 699,199 now U.S. Pat. No. 3,510,950. FIG. 3 also shows the slotted 34 end and 33 of the nib-ended stud means (not shown). The slot 34 is slidably engaged in a substantially flat portion 32 of web 131 having a top edge 31 so that any conventional longitudinally long transverse rib or nib as is generally used and shown in the L. S. Starrett U.S. Pat. No. 282,583; in the E. P. King U.S. Pat. No. 1,525,813; in the E. I. King U.S. Pat. No. 2,448,440 and generally J. W. Parker U.S. Pat. No. 1,529,209, issued Mar. 10, 1925, for a non-rotatable patented transverse rib or nib ended stud, generally for the same utility or non-rotatable stud and nib member of the E. I. King U.S. Pat. No. 2,448,440 reference. The dead-ended groove 2 of FIG. 6, for example, also being made wide enough so that any longitudinally long transverse nib 17 or of the above prior art may be pivoted 180 degrees therein or in the dead-ended 46 portion of the now wide groove 2 (not shown).

By the use of web 32 and slot 34 (not shown) in FIG. 3, the longitudinally long transverse rib or nib 17, shown in FIG. 2, or even a short nib 17, for example, as shown in FIG. 25 of the Ser. No. 699,199 application now U.S. Pat. No. 3,510,950 on the end (not shown) of the rule 1 or 57 releasably clamping stud means will always be aligned for quick and efficient entry into groove 2, whenever the rule 1 or 57 is entirely detached from the head 116. FIG. 3 further shows the head 116 side edge 26, top edge 28, side 45° edge 27, deep slot 39 for receiving member 38 therein and the bottom 40 portion of the deep slot 39. FIG. 3 shows slot 181 if slot 39 is not used in head 116. The character 42 indicates the downwardly curved center of deep slot 39. FIG. 3 shows a partial section of a concavo-convex tape measure housing 36, that is shown and disclosed in FIGS. 6, 7, 28 and 30 of copending application Ser. No. 699,199. Shown is the moved dashed line outline 331 of stud end 33, as required for releasably clamping rule 1 or 57 substantially to head 116. The rule 57 has a groove 2 formed in one longitudinal face portion 44 thereof.

FIG. 4 shows a portion of one end of rule 1 having the enlarged opening 8 entirely through 9 the thickness of rule 1. The opening 8 is generally tear-drop shaped and having a necked down opening 47 in alignment with groove 2 to thereby facilitate reentry of nib 17 into groove 2. Short groove 11 is shown without any obstruction or raised boss 48 therein, as seen in FIG. 5.

FIG. 5 shows an end of rule 1 having its outer end 56 edge portion thereof, as in FIGS. 1, 4, 6, 12 and 15. Shown is a substantially heart-shaped enlarged opening 8 having a necked down portion 47, a bottom wall 8′ of the opening 8 and opening 9 substantially through the wall 8′. The rear wall 10 of opening 8 is here shown as having a still greater rearward curve than that of FIGS. 1, 13 and 15 for obtaining a still softer glancing blow of nib 17 against curved wall 10. The necked down 47 portion is here also of a greater length to aid entry and reentry of nib 17 into groove 2. The raised boss 48 may be eliminated, if desired.

FIG. 6 shows a conventionally narrow dead-ended 46 groove 2, which also will be made into a wide groove 2 (not shown), as disclosed for the use in FIG. 3, terminating a short-distance from the outer end 56 edge portion of rule 1. The term short-distance in this specification is to mean a distance which is shorter than the distance from the middle of the groove 2 to at least one rectilinear longitudinal edge 14 or 15 which are shown in FIG. 1, for example. The short-distance 45 having a short groove 11 therein as is generally shown in FIGS. 1, 4, 5, 9, 10, 11, 14 and 11, for example.

The hole 52 may be used for inserting a pin type of nib 17 stop means, if a narrow conventional grooved 2 rule member 57 as in the L. S. Starrett U.S. Pat. No. 282,583 is used. The integral faced short-distance 45 portion of rule member 1 may also be generally simulated by riveting, soldering, cementing, welding or brazing a piece of material into the otherwise short groove 11 for creating the groove 2 dead end version, shown in FIG. 6, by use of the conventional grooved 2 rule 1 or the member 57 as shown in the Starrett U.S. Pat. No. 282,583 and in FIG. 3, having no enlarged opening 8 therein.

The dead-end 46 of groove 2 will only receive a short nib 17 or a spherical faced nib 17 shown as 37 in FIGS. 25 and 26 of copending 699,199 application for the 180 degree pivoting operation if a conventional rule 1 is used. The shown narrow conventional groove 2 may also be of a greater width for use as was generally disclosed in the disclosure of FIG. 3 hereabove to generally receive and allow a longitudinally long transverse nib to turn around or substantially pivot in the otherwise enlarged (not shown) dead-end portion of rule 1. The other end (not shown) of groove 2 is open ended, generally as shown, and would exit out through an outer end edge portion of rule 1 in the conventional way. The open ended groove 2 would be as generally is shown in FIG. 16 of the Ser. No. 699,199 application.

FIG. 7 shows rule 1 with groove 2, enlarged opening 8 and opening 9, as taken from FIG. 5 along line 3—3.

FIG. 8 shows rule 1 having opening 8, 9 and necked down 47 portion of opening 8 in line with groove 2, taken along line 2—2 of FIG. 4.

FIG. 9 shows an end portion of a slotted 59 and grooved 11 version of rule 1 end. Slot 59 and enlarged opening 8 is conventional but short groove 11 allows nib 17 means (not shown) to exit out of rule 1, to be in keeping with this pivoting rule invention.

FIG. 10 shows groove 2, short groove 11, enlarged opening 8 in a generally pear-shape configuration. Opening 52 may be used for center punching a surface therethrough, if so desired. Wall 8′ may be solid without opening 52, if desired.

FIG. 11 shows a generally tear-dropped shaped enlarged opening 8 having wall 8′, opening 9 through wall 8′ and an opened up 51 entrance into short groove 11 to facilitate the entry of a nib means therein when it is desired to entirely detach or disengage the nib means 17 from rule 1. Notch 12 is also shown, as is the tapped hole 13, accordingly.

FIG. 12 shows a shortened rule 1 having one end of groove 2 enter into a slot end 60 of slot 59 which enters into an enlarged opening 8. Nib 17 means is slid out of groove 2 when it is desired to detach the rule 1 from head 16 or 116 (not shown). The outer end 56 edge portion having a solid integral area 45 in the face of rule 1.

FIG. 13 shows tapped hole 13, groove 2, necked down opening 47, inside wall 7 of opening 47, bottom wall 8′ of enlarged heart-shaped opening 8, opening 9 through the wall 8′, integral (short distance) face portion 45 and notch 12 in one end portion of rule 1. Rear curved wall 10 is also shown.

FIG. 14 shows a cut of end portion of rule 1 having groove 2 with a rigidly secured and substantially integral insert 451 inserted in the otherwise short groove 11 whereby an integral face portion 45 is achieved, generally as shown in FIGS. 6, 12, and 13, to prevent the nib 17 (not shown) from exiting out of this end of rule 1, accordingly. The 451 insertion could also be inserted into one end of groove 2, of, for example, a conventional grooved rule 57 means (not shown) or in the groove *e* which is shown in L. S. Starrett 1883 device, U.S. Pat. No. 282,583 to create a dead end groove 2 or *e*. This view of the enlarged opening 8 is otherwise generally similar to that shown in FIG. 11.

FIG. 15 shows a cut off reduced length of rule 1 showing notch 12 with the dashed line end diameter of a center punch means 53 generally being a Starrett No. 819 automatic centering punch means and showing the center point 54 of the punch 53 intersecting in the middle of the outer end 55 edge portion and edge 15 of rule 1, whereby no measurement or indicia need be added or subtracted for a center punch 53 operation, with this notched corner 12 of rule 1. The FIG. 15 shows two enlarged, heart-shaped openings 8, one in each end of rule 1 in accordance with this invention, as desired. Tapped hole 13, raised boss 48, two short grooves 11, two openings 9 and two wall 8' portions of opening 8 are also shown, and which arrangement may, or any portion thereof, be also used in rule 1 of FIGS. 1, 3, 4, 5, 10, 11–14, as desired.

Reference should be made back to FIG. 1, wherein it shows a nut 791 having a compression spring 18 therein which spring 18 may be eliminated since it is not absolutely necessary for forcing the nib 17 against the wall 7, as disclosed in FIG. 1, if so desired. The nut 791 is thereby first loosened only about 1 or 2 revolutions, for example, thereby loosening the nib 17 from being clamped in groove 2, and as a person slides the head 16 longitudinally to the left, along the longitudinal length of the rule member, he merely manually pulls down on the nut 791, thereby forcing the nib 17 to slide along a portion of the wall 7, or in the air across the enlarged opening 8 and down against the rear wall 10, shown in FIG. 1. Now to slip the nib 17 out of the short groove 11 substantially the same operation is repeated, except that a person now manually forces the nut 220 or nut 791 upwards, and against the end of stud housing 25, whereby nib 17 slips substantially clean through short groove 11 and out of the rule 1. The nut 220 or 791 should not, for example, by loosened more than, say ¼ to ½ of a revolution, otherwise the nib 17 may possibly strike against the top or other wall portion of groove 11, and thereby possibly prevent the nib 17 from slipping out of short groove 11.

The outwardly curved wall 51 creates a bell mouth entrance or wide walled 51 opening which would generally prevent the above disclosed nib 17 from not exiting clean out of the short groove 11, because the nib 17 would slidingly strike the curved bell mouth 51 portion and then slip generally clean out of the short groove 11 in generally the same way that the slanted or curved wall 7, of FIGS. 1, 4, 5, 10, 11, 13, 14 and 15, of opening 8, aids the entry and reentry of nib 17 into the groove 2.

While I have shown and described the preferred embodiment of my invention, I do not wish to limit the invention to the exact the precise details of the shown and disclosed structure, and reserve the right to make all modifications and changes so long as they remain within the scope of the invention and the following claims.

I claim:

1. A rule member for a subcombination head means of a combination tool means, comprising: an elongated graduated and groove rule member having graduations and corresponding indicia along at least one longitudinal face edge portion thereof; said member having a longitudinally extending groove in at least one face edge portion thereof and an enlarged opening is provided in at least one said face edge portion of said member and having said groove terminating into said opening for forming an enlarged dead-end portion of said groove terminating a short-distance from an outer edge portion of said member while a second end of said groove having an open-end and substantially exiting through one portion of a second end edge portion of said member wherein a second enlarged opening is provided in at least one face edge portion of said member and being spaced a short-distance from said second end edge portion of said member and having said groove leading substantially into and out of said second opening for forming a short groove on one side of said second opening; said member is so constructed that when at least one portion of a nib means of a grooved rule releasably clamping means is slidingly engaged in at least one portion of said groove for being, in one operation, either substantially slidingly engaged in said dead-end portion of said groove for allowing said member to be substantially pivoted 180° substantially on said nib means and substantially in said head means for presenting a different set of said graduations and said indicia to at least one side edge portion of said head means or be slidingly slipped substantially through said second end edge portion of said member and out of said open-end of said groove for slidingly disconnecting said head means substantially along an axial length of said groove and from said member and without disassembling any portion of said rule releasably clamping means for releasably clamping said member substantially to said head means and said member can be substantially pivoted 180° on either end thereof by use of said enlarged openings and when said nib means is engaged therein and which nib means may also be slidingly slipped out through said short groove for disconnecting said member from said head means.

2. An elongated graduated grooved and slotted rule member, for a subcombination head means of a combination tool means, comprising: an elongated graduated, grooved and slotted rule member having graduations and corresponding indicia along at least one longitudinal face edge portion thereof; said member having a longitudinally extended slot having two closed ends; said slot extending longitudinally through at least one longitudinal face edge portion of said member and at least one of said closed ends of said slot terminating a short-distance from at least one of two outer end edge portins of said member; said member having at least one longitudinally extending groove in at least one longitudinal face edge portion thereof with one open end of said groove substantially entering through at least one portion of one of said outer end edge portions while the other open end of said groove substantially exits into one end of said slot; said member is so constructed that when a nib means of a grooved rule releasably clamping means is generally slipped into and through said groove and into said slot said member may then, in one operation, be either adjustable releasably clamped to said head means by having said nib means releasably clamped generally to at least one longitudinal inside wall portion of said slot or be substantially pivoted 180° substantially in said head means while having the further option of also intentionally slipping said nib means back out of said groove for intentionally disconnecting said member from said head means.

3. The said rule member of claim 2 wherein said two closed ends of said slot terminate a short-distance from said two outer end edge portions of said member; said rule member is so constructed that said nib means is substantially pivoted 180° in either of said closed ends of said slot when said member is substantially being pivoted 180° in said head means.

4. The said rule member of claim 2 wherein at least one of said closed ends of said slot is substantially an enlarged opening for creating a substantially diagonal short-distance from at least one inside wall portion of said opening to at least one outside corner portion of said member; said member is so constructed that it can be more interchangeably used in conventional subcombination head means when said member is substantially pivoted 180° substantially in said subcombination head means.

5. A grooved rule member for a subcombination head means of a combination tool means, comprising: an elongated graduated and grooved rule member having a first and a second outer end edge portion and having graduations and corresponding indicia along at least one longitudinal face edge portion thereof; said member having in at least one face edge portion thereof a substantially enlarged cavity having a bottom wall portion; said cavity being spaced a short-distance from said second outer end edge portion of said member; said member having a longitudinally extending groove in one face edge portion thereof and said groove substantially entering through one portion of said first outer end edge portion and extending longitudinally into said cavity; said bottom wall portion having an opening through a thickness portion thereof for nestingly receiving at least one end portion of a center punching means for substantially aiding in accurately center punching a surface; said member is so constructed that by use of said cavity disfigurement of one face edge portion thereof is substantially prevented and said member can, in one operation, be either substantially pivoted 180° substantially in said head means when a nib means of substantially said head means is engaged in said cavity or said member can be longitudinally slidingly disconnected from said nib means and said head means.

6. A grooved rule member for a subcombination head means of a combination tool means, comprising: an elongated graduated and grooved rule member having a first and a second outer end edge portion and having graduations and corresponding indicia along at least one longitudinal face edge portion thereof; said member having in at least one face edge portion thereof a substantially enlarged cavity having a bottom wall portion; said cavity being spaced a short-distance from said second outer end edge portion of said member; said member having a longitudinally extending groove in one face edge portion thereof and said groove substantially entering through one portion of said first outer end edge portion and extending longitudinally into said cavity; said cavity is substantially heart-shaped; said member is so constructed that by use of said cavity disfigurement of one face edge portion thereof is substantially prevented and said member can, in one operation, be either substantially pivoted 180° substantially in said head means when a nib means of substantially said head means is engaged in said cavity or said member can be longitudinally slidingly disconnected from said nib means and said head means and at least one rear wall portion of said conity is substantially rearwardly curved to prevent damage to said nib means and having a substantially pointed and necked down portion which blends substantially into one open end portion of said groove for aiding the entry and reentry of said nib means into said groove especially when said member is substantially pivoted 180° substantially on said nib means and in said head means.

7. A grooved rule member for a subcombination head means of a combination tool means, comprising: an elongated graduated and grooved rule member having a first and a second outer end edge portion and having graduations and corresponding indicia along at least one longitudinal face edge portion thereof; said member having in at least one face edge portion thereof a substantially enlarged cavity having a bottom wall portion; said cavity being spaced a short-distance from said second outer end edge portion of said member; said member having a longitudinally extending groove in one face edge portion thereof and said groove substantially entering through one portion of said first outer end edge portion and extending longitudinally into said cavity which is substantially a pear-shaped cavity; said pear-shaped cavity having a substantially necked down pointed portion thereof leading blendingly into an open end portion of said groove for aiding in the entry and reentry of said nib means into said groove especially when said member is substantially pivoted 180° substantially on said nib means and in said head means; said pear-shaped cavity also having two curved portions which create a short-distance diagonally to two corners of said member for effecting a more efficient and convenient pivoting substantially 180° operation of said member substantially in said head means; said member is so constructed that by use of said cavity disfigurement of one face edge portion thereof is substantially prevented and said member can, in one operation, be either substantially pivoted 180° substantially in said head means when a nib means of substantially said head means is engaged in said cavity or said member can be longitudinally slidingly disconnected from said nib means and said head means.

8. A rule member for a subcombination head means of a combination tool means, comprising: an elongated rule member having graduations and corresponding indicia along at least one longitudinal face edge portion thereof; said member having a longitudinally extending groove in at least one face edge portion thereof; said groove extending longitudinally into at least one enlarged cavity having a bottom wall; said enlarged cavity is provided in at least one face edge portion of said member; said enlarged cavity being spaced a short-distance from at least one outer end edge portion of said member and at least one portion of said wall having an opening through a thickness portion thereof; said member having at least one short groove which has both of its ends open and having said short groove in at least one face edge portion thereof; said short groove exits substantially out of said enlarged cavity and substantially out of at least one outer end edge portion of said member; said member is so constructed that when at least one portion of a nib means is slidingly engaged in at least one portion of said cavity said member, in one operation, can be either substantially pivoted 180 degress in said head means for presenting a different set of sad graduations and said indicia to at least one side edge of said head means or said nib means can be slidingly slipped substantially longitudinally out of said cavity and through said short groove for disconnecting said member from said nib means and from said head means and without disassembling any portion of a grooved rule releasably clamping means for releasably clamping said member to said head means and so that disfigurement of at least one face edge portion of said member is prevented by said enlarged cavity and so that at least one end portion of a center punching means can be nestingly inserted into said opening in said wall for aiding in accurately center punching a surface.

9. A rule member for a subcombination head means of a combination tool means, comprising: an elongated rule member having graduations and corresponding indicia along at least one longitudinal face edge portion thereof; said member having a longitudinally extending groove in at least one face edge portion thereof; said groove extending longitudinally into at least one substantially heart-shaped enlarged opening which is provided in at least one face edge portion of said member; said enlarged opening being spaced a short-distance from at least one outer end edge portion of said member; said opening having at least one portion of a substantially necked down and substantially pointed portion of said opening towards a center portion of said member and blending substantially into at least one end of said extending groove; said member having at least one short groove which has both of its ends open and having said short groove in at least one face edge portion thereof; said short groove exits substantially out of said enlarged opening and substantially out of at least one outer end edge portion of said member; said member is so constructed that when at least one portion of a nib means is slidingly engaged in at least one portion of said opening said member, in one operation, can be either substantially pivoted 180° in said head means for presenting a different set of said graduations and said indicia to at least one side edge of said head means or said nib means can be slidingly slipped substantially longitudinally out of said opening and through said short groove for disconnecting said member for said nib means and from said head means without disassembling any portion of a grooved rule releasably clamping means for releasably clamping said member to said head means and so that said nib means is substantially aided in its entry and reentry into said extending groove when said member is substantially pivoted 180° substantially in said head means and said nib means is prevented from being damaged when it is longitudinally slipped out of said extending groove and is substantially glidingly slid against one of two outwardly curved wall portions of said heart-shaped opening.

10. The said rule member of claim 9 wherein said integral portion of said member is horizontally across an entire bottom of at least one said opening whereby disfigurement of an opposite face portion of said member is substantially prevented by said opening.

11. The said rule member of claim 10 wherein said wall portion is provided with an opening through its thickness portion for accurately nesting therein at least one end portion of a center punching means for aiding in accurately center punching a surface.

12. A rule member for a subcombination head means of a combination tool means, comprising: an elongated rule member having graduations and corresponding indicia along at least one longitudinal face edge portion thereof; said member having a longitudinally extending groove in at least one face edge portion thereof; said groove extending longitudinally into at least one substantially tear-drop shaped enlarged opening which is provided in at least one face edge portion of said member said enlarged opening being spaced a short-distance from at least one outer end edge portion of said member; said opening having at least one portion of a substantially necked down and substantially pointed portion thereof substantially blending into at least one open end portion of said longitudinally extending groove with said pointed portion substantially pointed towards a center longitudinal portion of said member whereby efficient entry and reentry of said nib means which is guided by said pointed portion of said opening into said extending groove is obtained; said member having at least one short groove which has both of its ends open and having said short groove in at least one face edge portion thereof; said short groove exits substantially out of said enlarged opening and substantially out of at least one outer end edge portion of said member; said member is so constructed that when at least one portion of a nib means is slidingly engaged in at least one portion of said opening said member, in one operation, can be either substantially pivoted 180° in said head means for presenting a different set of said graduations and said indicia to at least one side edge of said head means or said nib means can be slidingly slipped substantially longitudinally out of said opening and through said short groove for disconnecting said member from said nib means and from head means and without disassembling any portion of a grooved rule releasably clamping means for releasably clamping said member to said head means.

13. A rule member for a subcombination head means of a combination tool means, comprising: an elongated graduated and grooved rule member having graduations and corresponding indicia along at least one longitudinal face edge portion thereof; said member having an enlarged opening and a longitudinally extending groove in at least one face edge portion thereof and having said groove terminating into said opening for forming an enlarged said dead-end portion of said groove; said opening having a substantially necked down and substantially pointed portion thereof blending substantially into said groove for obtaining a more efficient guiding reentry of a nib means back into said groove when said member is substantially pivoted 180° substantially on said nib means in said head means and having a portion of said opening terminating a short-distance from an outer end edge portion of said member while a second end of said groove having an open-end and substantially exiting through one portion of a second end edge portion of said member; said member is so constructed that when at least one portion of said nib means of a grooved rule releasably clamping means is slidingly engaged in at least one portion of said opening for being, in one operation, either substantially slidingly engaged in said opening for allowing said member to be substantially pivoted 180 degress substantially on said nib means and substantially in said head means for presenting a different set of said graduations and said indicia to at least one side edge portion of said head means or be slidingly slipped substantially through said second end edge portion of said member and out of said open-end of said groove for slidingly disconnecting said head means substantially along an axial length of said groove and from said member and without disassembling any portion of said rule releasably clamping means for releasably clamping said member substantially to said head means.

14. A grooved rule member for a subcombination head means of a combination tool means, comprising: an elonagted graduated and grooved rule member having a first and a second outer end edge portion and having graduations and corresponding indicia along at least one longitudinal face edge portion thereof; said member having in at least one face edge portion thereof a substantially enlarged cavity having a bottom wall portion; said cavity being spaced a short-distance from said second outer end edge portion of said member; said member having a longitudinally extending groove in one face edge portion thereof and said groove substantially entering through one portion of said first outer end edge portion and extending longitudinally into said cavity; said cavity having a substantially necked down and substantially pointed portion which blends substantially into said groove for obtaining a more efficient guiding reentry of a nib means back into said groove when said member is substantially pivoted 180° substantially on said nib means and substantially in said head means; said member is so constructed that by use of said cavity disfigurement of one face edge portion thereof is substantially prevented and said member can, in one operation, be either substantially pivoted 180° substantially in said head means when a nib means of substantially said head means is engaged in said cavity or said member can be longitudinally slidingly disconnected from said nib means and said head means.

15. The rule member of claim 14 wherein said member having a short groove in at least one face edge portion thereof; said short groove substantially exits through at least one portion of said second outer end edge portion of said member while the other open end of said short groove exits into said cavity; said member is so constructed that by use of said nib means in said short groove said nib means may, in one operation, substantially enter or exit out of either said first outer end edge portion of said second outer end edge portion of said member and without disassembling any portion of a releasably clamping means having a nib means for releasably clamping said member to said head means.

* * * * *